United States Patent [19]

Ohashi

[11] Patent Number: 4,765,148

[45] Date of Patent: Aug. 23, 1988

[54] AIR CONDITIONING SYSTEM INCLUDING PUMP DRIVEN BY WASTE HEAT

[75] Inventor: Kotaro Ohashi, Tokyo, Japan

[73] Assignee: Nihon Radiator Co., Ltd., Tokyo, Japan

[21] Appl. No.: 110,864

[22] Filed: Oct. 21, 1987

[30] Foreign Application Priority Data

Oct. 22, 1986 [JP] Japan ..... 61-249478

[51] Int. Cl.[4] ..... F25B 1/00

[52] U.S. Cl. ..... 62/116; 62/114; 62/500

[58] Field of Search ..... 62/114, 116, 500

[56] References Cited

U.S. PATENT DOCUMENTS

| | | | |
|---|---|---|---|
| 3,602,295 | 8/1971 | Klaas | 62/500 |
| 3,922,877 | 12/1975 | Ophir et al. | 62/500 |
| 3,988,901 | 11/1976 | Shelton et al. | 62/116 |
| 4,342,200 | 8/1982 | Lowi, Jr. | 62/191 |
| 4,345,440 | 8/1982 | Allen | 62/500 |
| 4,438,633 | 3/1984 | Hiser | 62/500 |
| 4,625,522 | 12/1986 | Cheron et al. | 62/114 |

FOREIGN PATENT DOCUMENTS 57-134668 8/1982 Japan .

*Primary Examiner*—Ronald C. Capossela

*Attorney, Agent, or Firm*—Foley & Lardner, Schwartz, Jeffery, Schwaab, Mack, Blumenthal & Evans

[57] ABSTRACT

A cooling system which uses a jet or ejector pump in place of a mechanically driven compressor includes a working fluid composed of two or possibly more different refrigerants. One has a low saturation temperature while the other has a higher one. The mixture of the two refrigerants is subject to a distillation or separation. Following the separation the low saturation temperature refrigerant (vapor) is condensed in an auxiliary condenser and inducted through the evaporator while the higher saturation temperature refrigerant (liquid) is returned to a boiler for vaporization and subsequent used in the jet pump which produces the pressure reduction via which the low saturation temperature refrigerant is inducted into the evaporator.

8 Claims, 2 Drawing Sheets

AIR CONDITIONING SYSTEM INCLUDING PUMP DRIVEN BY WASTE HEAT

BACKGROUND OF THE INVENTION

1. Field of the Invention

The present invention relates generally to an air conditioning and/or refrigerating system and more more specifically to a refrigeration arrangement for use therein which includes a waste heat powered jet pump.

2. Description of the Prior Art

In automotive air conditioning systems which employ a mechanically driven compressor a drawback is encountered in that the operation of the compressor places an additional load on the engine of the vehicle, which both increases the amount of fuel which is combusted and reduces the power available at the driven wheels of the vehicle. This problem is particularly evident in large buses, refrigerator trucks and the like, wherein the demand for air conditioning and/or refrigeration is particularly high.

In order to overcome this problem it has been proposed to utilize the waste heat of the engine in a Rankine cycle arrangement in manner which permits the load on the engine per se to be reduced.

FIG. 1 shows one example of the above mentioned systems which was disclosed in Japanese Patent Application First Provisional Publication No. 57-134668. As shown, this arrangement comprises a boiler 1 which includes a heating coil and which is partially filled with a refrigerant liquid. The coil 2 is operatively connected with the engine (not shown) and arranged so that heated fluid such as exhaust gas or engine coolant is passed therethrough. During engine operation the liquid refrigerant in the boiler 1 is heated to the degree that it boils and produces high temperature and pressure refrigerant vapor.

The high pressure and temperature refrigerant vapor produced in the boiler 1 passes through a first conduit 4 and is introduced into an ejector or jet pump 6 via a nozzle 8. The jet of vapor which issues from the nozzle 8 induces a low pressure in a mixture chamber 10 which surrounds the nozzle and induces a flow of fluid from an evaporator 12 to enter the chamber. The inducted fluid is subsequently carried along with the vapor ejected from the nozzle 8 to a condenser 14.

The condenser 14 in this instance takes the form of a heat exchanger through which a fan forced daft of air is induced to flow.

A small reservoir 16 in which the condensate from the condenser is collected and temporarily stored is disposed downstream of the condenser 14. A return pump 18 inducts the liquid refrigerant from the reservoir 16 and pumps the same back into the boiler 1. The evaporator 12 communicates with the conduit 20 interconnecting the reservoir 16 and the pump 18 via an expansion valve 22. The valve 22 permits a fraction of the liquid refrigerant flowing through the conduit 20 to be lead into the evaporator 12 wherein it expands and absorbs the heat contained in a flow of air passing through the devices. In this instance the evaporator 12 is included in an automotive cabin air conditioning arrangement and the flow of air directed thereinto via a suitable flow control and ducting arrangement.

This device, while reducing the load on the engine by utilizing the waste heat which is released therefrom into the engine coolant or which is contained in the exhaust gases, has suffered from the drawbacks that:

With ejection type compressor arrangements the compression possible is small compared with a mechanically driven compressor and in order to obtain the best performance it is necessary to ensure that the pressure of the vapor fed into the nozzle 8 is high while the pressure in the condenser 14 is maintained low. Viz., as the compressor in this case takes the form of a heat engine, it is necessary to ensure that the temperature differential between the heat source and the heat sink is as large as possible. However, as the temperature of the high pressure vapor ejected from the nozzle 8 is high, the temperature of the condensate recycled to the evaporator 12 tends to become elevated after a brief period of operation. This tends increase the temperature of the liquid refrigerant entering the evaporator 12, reduce temperature to which the heat exchanging surfaces of the evaporator 12 can be lowered and thus reduce the amount of heat which can be removed from the air passing through the evaporator.

By way of example, if the working fluid of the above arrangement is selected to be FREON R11 or FREON 114 it is possible to lower the temperature of the evaporator 12 to 10° C. However, this level is not adequate and further requires the temperature in the condenser to be held at or below 40° C.

In the event that the ambient temperature is 30° C., the temperature differential between the cooling medium and the minimum temperature requirements of the condenser 14, is small and greatly hampers the removal of the necessary amount of heat therefrom.

In order to compensate for the above, it is necessary to avoid reductions in the condensation capacity (heat exchange capacity) of the condenser 14. However, as pointed out above, as the ambient atmospheric temperature increases the temperature differential between the heat exchanging surfaces and the cooling medium decreases whereby the amount of heat which can be removed from the condenser is decreased. In order to ensure that acceptable operation is obtained (viz., the required amount of heat can be absorbed and released) the size of both the condensor and the evaporator have to be enlarged. This increases the weight and bulk of the system undesirably. However, even when large scale condensers and evaporators are used, still there tend to be instances wherein the operational characteristics become unacceptable. For example when the ambient temperature rises to 40° C. or above.

SUMMARY OF THE INVENTION

It is an object of the present invention to provide a cooling/refrigerating system of the above type which is compact and which additionally provides improved performance.

In brief, the above object is achieved by an arrangement wherein a cooling system which uses a ejector pump in place of a mechanically driven compressor, utilizes a working fluid composed of two or possibly more different refrigerants. One has a low saturation temperature while the other has a higher one. The mixture of the two refrigerants is subject to a distillation or separation. Following the separation, the low saturation temperature refrigerant (vapor) is condensed in an auxiliary condenser and inducted through the evaporator while the higher saturation temperature refrigerant (liquid) is returned to a boiler for vaporization and subsequent use in the ejection pump.

More specifically, a first aspect of the present invention takes the form of a refrigerating system which features: a boiler in which a working fluid can be heated to the point of vaporizing; a jet pump, the jet pump being fluidly communicated with the boiler in a manner to receive the high pressure temperature vapor generated therein and create a low pressure zone; a main condenser fluidly communicated with the jet pump for condensing the effluent from the jet pump; a separating unit fluidly communicated with the main condensor for separating the liquified effluent into a first refrigerant having a first saturation temperature and a second refrigerant having a second saturation temperature which is higher than that of the first one; a pump for pumping the second refrigerant in liquid form from the separating unit to the boiler; an auxiliary condenser for receiving the first refrigerant in vapor form and condensing the same to its liquid state; an evaporator fluidly interposed between the auxiliary condenser and the low pressure zone in the jet pump; and an expansion valve which controls the amount of first refrigerant which is permitted to be inducted into the evaporator.

A second aspect of the invention comes in the form of a method of refrigeration which features the steps of: (a) using a working fluid composed of a first refrigerant having a first saturation temperature and a second refrigerant having a second saturation temperature which is higher than that of the first refrigerant; (b) separating the first and second refrigerants; (c) pumping the second refrigerant in liquid form into a boiler; (d) heating the second refrigerant in the boiler to produce a high temperature pressure vapor; (e) ejecting the high temperature pressure vapor through a nozzle of a jet pump to create a low pressure; (f) supplying the first refrigerant in vapor form into an auxiliary condenser and condensing the same; (g) inducting the liquified first refrigerant into an evaporator using the low pressure produced in step (e); (h) mixing the first and second refrigerant and introducing the mixture into a main condenser; and repeating steps (b) to (h).

A further aspect of the invention is defined by a refrigeration system which features: a working fluid composed of a first refrigeration having a first saturation temperature and a second refrigerant having a second saturation temperature which is higher than that of the first refrigerant; means for separating the first and second refrigerants; a pump for pumping the second refrigerant in liquid form into a boiler in which the second refrigerant is heated to produce a high temperature pressure vapor; a jet pump including a nozzle through which the high temperature pressure vapor from the boiler is ejected to create a low pressure; an auxiliary condenser which receives the first refrigerant from the separating means in vapor form and in which the first refrigerant is condensed to its liquid state; an evaporator into which the liquified first refrigerant is inducted by the low pressure produced in the jet pump; and a main condenser into which a mixture of the first and second refrigerants from the jet pump is introduced, condensed and subsequently returned to the separating means.

DESCRIPTION OF THE PREFERRED EMBODIMENTS

Figure 1:
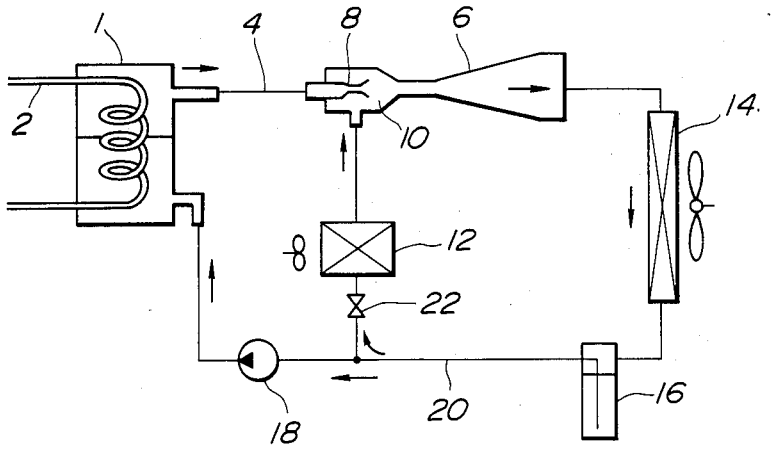
FIG. 1 (PRIOR ART)
FIG. 1 shows in schematic layout form the prior art arrangement discussed in the opening paragraphs of the present invention.
Figure 3:
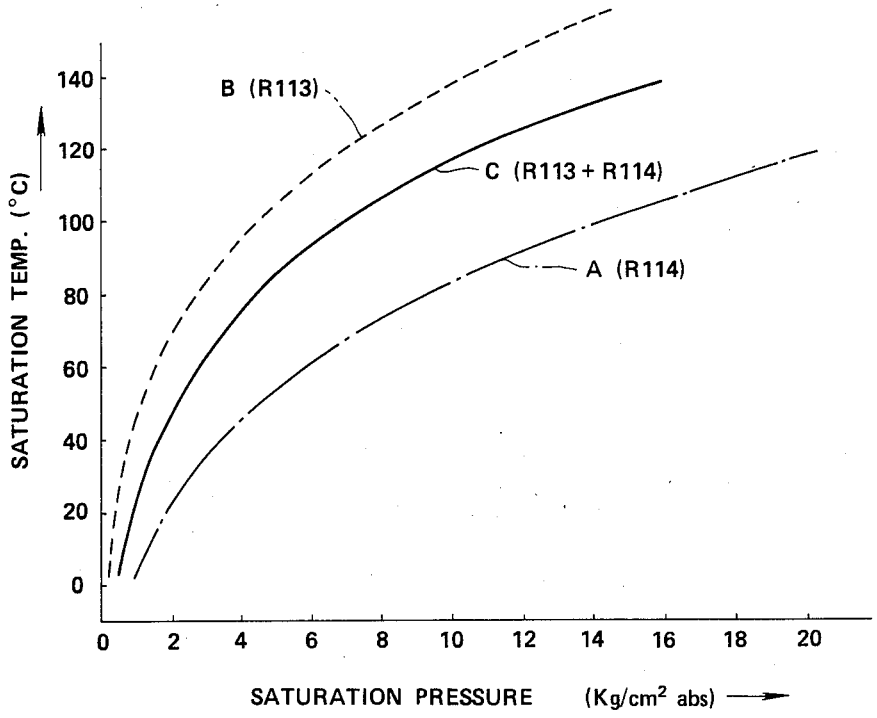
FIG. 3 is a graph showing in terms of saturation pressure and saturation temperature the characteristics of the two types of refrigerant and a mixture thereof used in the first embodiment of the present invention.
Figure 2:
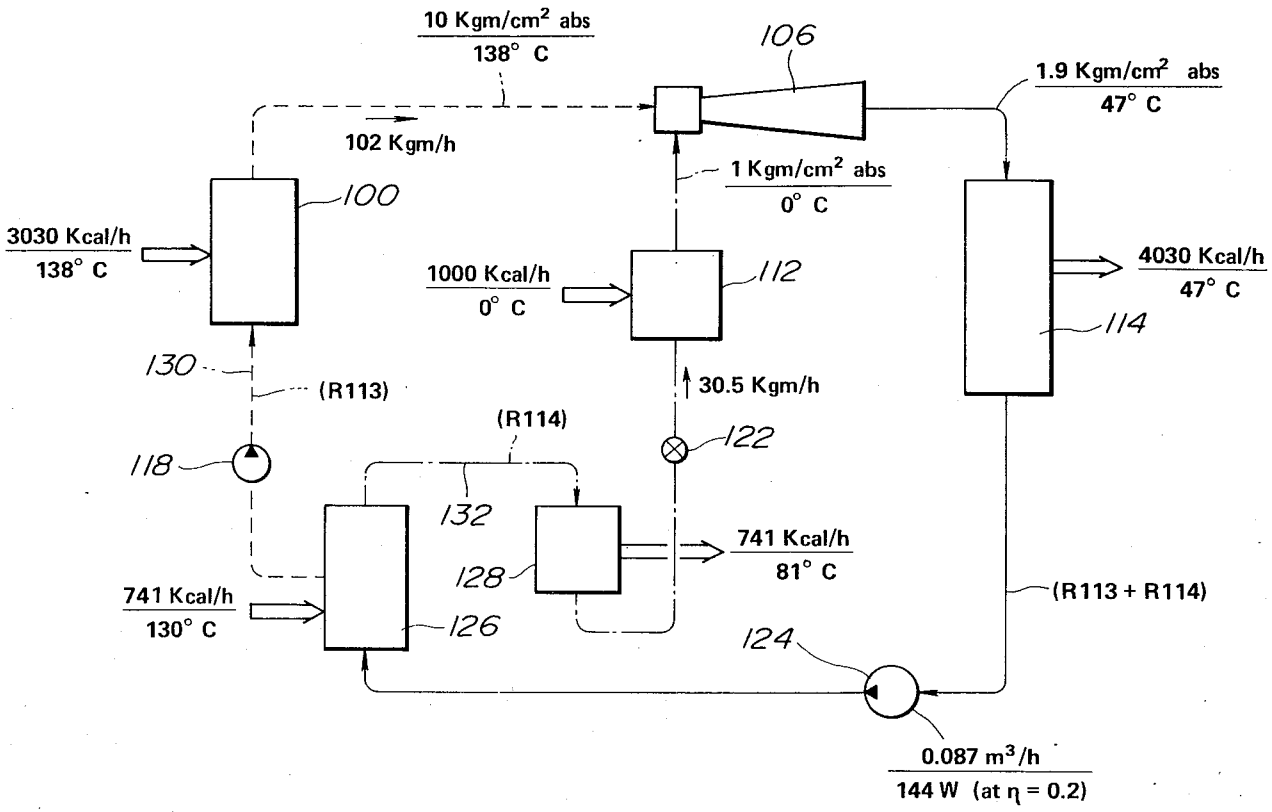
FIG. 2 shows schematically the layout which characterizes a first embodiment of the present invention.

FIG. 2 shows an embodiment of the present invention. This arrangement is structurally similar to that disclosed in connection with FIG. 1 but further inludes a pressure pump 124, a distillation or separation unit 126 and an auxiliary condenser 128 circuited between the main condenser 114 (as it will be referred to hereinafter) the liquid refrigerant return pump 118 and the evaporator 112, in the illustrated manner. However, in this instance the working fluid is composed to two different types of refrigerant which have different saturation temperatures. By way of example FREON R113 and FREON R114 which are mixed in a 7:3 vol. ratio (R113/R114=7/3). The characteristics of these refrigerants are shown in FIG. 3 wherein traces A, B and C respectively denotes saturation temperature/pressure characteristics of FREON R114, a mixture of FREON R113 and R114, and FREON R113.

As will be noted one of the refrigerants (R114) has a relatively low saturation temperature while the other (R113) has a higher one. This feature is essential to the present invention as will become more apparent as the disclosure continues.

In brief, during operation, the refrigerant in the boiler 100 is heated and produces high pressure temperature vapor which is ejected from a nozzle (not shown) of essentially the same nature as that used in the FIG. 1 arrangement. This produces a low pressure in the mixture chamber (also not shown) of the device and inducts the refrigerant out of the evaporator 112. The mixture of the refrigerants is fed into the main condenser 114 wherein heat is released and the vapor is converted to its liquid state. Subsequently, the condensate is inducted and pumped by way of pressure pump 124 to the distillation or separation unit 126. It will be noted that, although not shown, a small reservoir may be disposed upstream of the pressure pump 124 in a manner similar to that illustrated in the FIG. 1 prior art arrangement.

The distillation or separation unit 126 functions to separate the high temperature saturation refrigerant liquid (R113) from the gaseous low temperature one (R114). The high temperature saturation refrigerant liquid (R113) is supplied to the boiler 100 by way of conduit 130 and return pump 118 while the low saturation temperature refrigerant vapor (R114) is supplied by way of conduit 132 to the auxiliary condenser 128. In the latter mentioned unit 126, heat is removed from the R114 vapor which is induced to condense and assume its liquid state.

The low saturation temperature liquid refrigerant R114 is controllably supplied into the evaporator by way of expansion valve 122.

Thus, as will be appreciated one of the refrigerants (R114) is selectively circulated through the evaporator 112 while the other (R113) is selectively circulated through the boiler 100.

In a more specific example of the invention, the pressure pump 124 is selected to have an efficiency of 0.2 (n=0.2) and a and a rating of 144 W. The pump 124 raises the pressure of the refrigrant to 10 Atmos. (10 Kg/cm3 abs), increases the temperature of the same to 130° C. by adding heat at a rate of 741 Kcal/h and produces an output of 0.087 m3 per unit time (0.087 m3/h). The boiler 100 is such as to raise the temperature of the R113 refrigerant therein to 138° C. (whereat it boils) and designed to impart heat thereto at a rate of 3030 Kcal per unit time (3030 Kcal/h). The evaporator 112 has an induction ratio of 0.3.

Thus, during operation the R113 in the boiler is raised to a temperature of 138° C. under a pressure of 10 Kg/cm2 abs. The high pressure temperature R113 vapor is ejected from the nozzle in the ejector at a rate of 102 Kg/h. This produces sufficient vacuum in the device to permit R114 to be inducted into the evaporator 112 at a rate of 30.5 Kg/h. This absorbs heat from the air being conditioned at a rate of 1000 Kcal/h and maintains the interior of the evaporator 112 at 0° C. and 1 Kg/cm2.

The blend of R114 and R113 discharged from the ejector 106 enters the main condenser 114 at a temperature of 47° C. and under a pressure of 1.9 Kg/cm2. The main condenser 114 extracts heat from the mixture of R114 and R113 at a rate of 4030 Kcal/h. As will be appreciated from trace C of FIG. 3, the pressure and temperature conditions under which the mixture of refrigerants enter the main condenser are close to those which meet the condensation requirements of the mixture of R114 and R113. Accordingly, the removal of a relatively small amount of heat will tend to induce condensation. Excessive cooling tends to interfer with the subsequent separation of the two refrigerants.

It will be noted that the minimum temperature to which the main condenser must be lowered is higher than that possible with the prior art. Viz., 47° C. as compared with 40° C.

As will be also appreciated from FIG. 3 at a pressure of 10 Atmos the saturation temperatures of R113 and R114 are 138° C. and 83° C. This means that there is a 55° C. differential between above mentioned temperatures which ensures that an essentially 100% separation of the two refrigerants can be achieved in the distillation or separation unit 126. The R114 which is supplied to the auxiliary condenser 128 enters the same at a temperature of 130° C. By removing heat from this unit at a rate of 741 Kcal/h it is possible to condense the R114 vapor and lower the temperature of the condensate to about 81° C.

From the above it will be clear that the amount of heat which need be removed from the working fluid by the main and auxiliary condensers 114 and 128 is relatively small and enables the use of small compact devices. In fact the amount of space consumed by the two condensers 114, 128 and the evaporator 112 of the above disclosed arrangement is such as to be less that occupied by the single large scale condenser 14 and evaporator 12 used in the FIG. 1 prior art arrangement.

It will be further noted that the invention is not limited to the use of the above mentioned refrigerant liquids and may be implemented with any suitable other two fluids which exhibit a suitable difference in saturation temperature and pressure. For example, a combination of FREON R22 and cyclohexane provides a more efficient working fluid which eliminates the need to pressurize the condensate discharged from the main condenser and permits the elimination of the pressure pump 124 from the circuit.

It is further possible to use 3 or more different refrigerants to compose the working fluid. However, under such conditions it is advantageous that two of the refrigerants form an azeotropic mixture having a boiling point (saturation temperature) which is suitably different from that of the third one.

The present invention is not limited to automotive applications and can be applied to other commercial and/or domestic applications wherein refrigeration or air conditions needs exist and a source of heat is available. Such sources may includes solar furnaces, furnaces combusting rubbish, furnace exhaust gases and the like.

What is claimed is:

1. In a refrigerating system:

a boiler in which a working fluid can be heated to the point of vaporizing;

a jet pump, said jet pump being fluidly communicated with said boiler in a manner to receive the high pressure temperature vapor generated therein and create a low pressure zone;

a main condenser fluidly communicated with said jet pump for condensing the effluent from said jet pump;

a separating unit fluidly communicated with said main condenser for separating the liquified effluent into a first refrigerant having a first saturation temperature and a second refrigerant having a second saturation temperature which is higher than that of the first refrigerant;

a pump for pumping the second refrigerant in liquid form from said separating unit to said boiler;

an auxiliary condenser for receiving the first refrigerant in vapor form and condensing the same to its liquid state;

an evaporator fluidly interposed between said auxiliary condenser and the low pressure zone in said jet pump; and an expansion valve which controls the amount of first refrigerant which is permitted to be inducted into said evaporator.

2. A refrigerating system as claimed in claim 1 further comprising a pressure pump, said pressure pump being disposed between said main condenser and said separating unit and arranged to increase the pressure of the condensate from the main condenser prior being supplied into said separating unit.

3. In a method of refrigeration, the steps of:

(a) using a working fluid composed of a first refrigerant having a first saturation temperature and a second refrigerant having a second saturation temperature which is higher than that of the first refrigerant;

(b) separating the first and second refrigerants;

(c) pumping the second refrigerant in liquid form into a boiler;

(d) heating the second refrigerant in the boiler to produce a high temperature pressure vapor;

(e) ejecting the high temperature pressure vapor through a nozzle of a jet pump to create a low pressure;

(f) supplying the first refrigerant in vapor form into an auxiliary condenser and condensing the same;

(g) inducting the liquified first refrigerant into an evaporator using the low pressure produced in step (e);

(h) mixing the first and second refrigerant and introducing the mixture into a main condenser; and repeating steps (b) to (h).

4. A method as claimed in claim 3 further comprising the steps of pressurizing the working fluid prior said step of separating in a manner which facilitates the separation of the first and second refrigerants.

5. A method as claimed in claim 3 further comprising the step of controlling the flow of liquified first refrigerant from said auxiliary condenser to said evaporator using an expansion valve.

6. In a refrigeration system a working fluid composed of a first refrigerant having a first saturation temperature and a second refrigerant having a second saturation temperature which is higher than that of the first refrigerant;

means for separating the first and second refrigerants;

a pump for pumping the second refrigerant in liquid form into a boiler in which the second refrigerant is heated to produce a high temperature pressure vapor;

a jet pump including a nozzle through which the high temperature pressure vapor from said boiler is ejected to create a low pressure;

an auxiliary condenser which receives said first refrigerant from said separating means in vapor form and in which said first refrigerant is condensed to its liquid state;

an evaporator into which the liquified first refrigerant is inducted by the low pressure produced in said jet pump; and a main condenser into which a mixture of the first and second refrigerants from said jet pump is introduced, condensed and subsequently returned to said separating means.

7. A refrigerating system as claimed in claim 6 further comprising a pressure pump, said pressure pump being disposed between said main condenser and said separating means, said pressure pump being arranged to increase the pressure of a mixture of said first and second refrigerants prior entry into said separating means in a manner which facilitates the separation.

8. A refrigerant system as claimed in claim 6 further comprising an expansion valve disposed between said auxiliary condenser and said evaporator for controlling the flow of liquified first refrigerant into said evaporator.

* * * * *